US009810236B2

(12) United States Patent
Chelf

(10) Patent No.: US 9,810,236 B2
(45) Date of Patent: Nov. 7, 2017

(54) FAN BLADE WITH FLEXIBLE AIRFOIL WING

(75) Inventor: Jonathan David Chelf, San Diego, CA (US)

(73) Assignee: AIRSTREAM INTELLIGENCE, LLC, Solana Beach, CA (US)

( * ) Notice: Subject to any disclaimer, the term of this patent is extended or adjusted under 35 U.S.C. 154(b) by 568 days.

(21) Appl. No.: 14/233,371

(22) PCT Filed: Jul. 19, 2012

(86) PCT No.: PCT/US2012/047477

§ 371 (c)(1),
(2), (4) Date: Jan. 16, 2014

(87) PCT Pub. No.: WO2013/013092

PCT Pub. Date: Jan. 24, 2013

(65) Prior Publication Data

US 2014/0154083 A1 Jun. 5, 2014

Related U.S. Application Data

(60) Provisional application No. 61/509,294, filed on Jul. 19, 2011.

(51) Int. Cl.
*F04D 29/38* (2006.01)

(52) U.S. Cl.
CPC ..... *F04D 29/382* (2013.01); *F05B 2240/311* (2013.01)

(58) Field of Classification Search
CPC ..... F04D 29/382; F05B 2240/311; F05B 2240/302; F05B 2240/312; F05B 2240/3121; F03D 3/06; F03D 3/061; F03D 3/062; F03D 3/064
USPC ..... 416/193 R, 226, 240, 132 R, 132 A, 416/132 B
See application file for complete search history.

(56) References Cited

U.S. PATENT DOCUMENTS 2,149,267 A 3/1939 Bouvy et al.
3,406,760 A 10/1968 Weir
(Continued)

FOREIGN PATENT DOCUMENTS

GB 01212127 A 11/1970
JP S5028008 A 3/1975
(Continued)

OTHER PUBLICATIONS

Japanese Office Action issued in Japanese Application No. JP 2014-521803, dated May 26, 2015.
(Continued)

*Primary Examiner* — Jason Shanske
*Assistant Examiner* — Kelsey Stanek
(74) *Attorney, Agent, or Firm* — Mintz Levin Cohn Ferris Glovsky and Popeo, P.C.

(57) ABSTRACT

A fan assembly is disclosed that includes one or more fan blades, each fan blade having a flexible airfoil wing. A curved, flexible wing is connected to a main spar element located between the upper and lower portions of the curved, flexible wing element. The curved, flexible wing forms the entire upper surface of the wing, the entire leading edge of the wing, and a portion of the lower surface of the wing.

19 Claims, 7 Drawing Sheets

(56) References Cited

U.S. PATENT DOCUMENTS

| | | | | | |
|---|---|---|---|---|---|
| 3,597,108 | A | * | 8/1971 | Mercer | B64C 27/46 244/17.11 |
| 3,614,032 | A | * | 10/1971 | Purcell, Jr. | B64C 31/028 114/123 |
| 4,547,126 | A | * | 10/1985 | Jackson | F04D 29/382 416/132 A |
| 5,181,678 | A | * | 1/1993 | Widnall | B64C 3/48 114/127 |
| 5,269,657 | A | * | 12/1993 | Garfinkle | B29C 70/20 244/124 |
| 5,996,685 | A | * | 12/1999 | Alizadeh | F04D 29/326 123/41.49 |

FOREIGN PATENT DOCUMENTS

| | | | |
|---|---|---|---|
| JP | S50033701 | Y | 10/1975 |
| JP | S50125109 | U | 10/1975 |
| JP | S57153998 | A | 9/1982 |
| JP | S59176499 | A | 10/1984 |
| JP | 2014521803 | A | 8/2014 |

OTHER PUBLICATIONS

International Search Report and Written Opinion of PCT/US2012/047477 dated Oct. 5, 2012.

* cited by examiner

FAN BLADE WITH FLEXIBLE AIRFOIL WING

CROSS-REFERENCE TO RELATED APPLICATION

This application is a national phase filing of and claims the benefit of priority of P.C.T. Patent Application No. PCT/US12/47477, filed on Jul. 19, 2012, entitled "FAN BLADE WITH FLEXIBLE AIRFOIL WING," which in turn claims priority under 35 U.S.C. §119(e) to U.S. Provisional Patent Application Ser. No. 61/509,294, filed on Jul. 19, 2011, entitled, "FANBLADE WITH FLEXIBLE AIRFOIL WING", the entire disclosures of which are hereby incorporated by reference herein.

BACKGROUND

The present invention relates to fans, and more particularly to flexible fan blades that operate over a large range of speed and pressure.

In conventional fan assemblies, a highly pitched, fixed-wing fan blade is efficient at low differential pressure with high output flow. However, the same highly pitched, fixed-wing fan blade stalls as the output flow approaches zero. At the point of stall, as the output flow decreases, the power input increases while the pressure increases very little or may decrease. This is equivalent to the stall of an airplane wing. When the angle of attack increases beyond a critical point, airflow across the top of the wing separates from the wing and continues without being deflected downward with the wing. Thus, because the airflow on the upper surface of the wing is not pulled downward by the wind, the wing is not pulled upward by the airflow above the wing. Thus, the plane loses lift, though the airflow on the lower surface of the wing continues to provide some lift as it is deflected downward.

For other fan assemblies, a low pitched, fixed-wing fan blade is efficient at high differential pressure with low output flow. No stall occurs. However, at low differential pressure, the same fan is inefficient and the output flow is low. The fan speed may be increased to increase the output flow, but the additional fan blade drag keeps the efficiency low and the power input high.

One design is to allow for variable pitch in the fan blade and hub assembly. This design provides for rotation of the fan blade along its longitude, thereby controlling the pitch. However, additional mechanisms must be provided to control the pitch according to differential pressure and/or fan speed. One disadvantage of this design is that the solid blade has a fixed helical twist (high pitch angle near the fan hub and lower pitch angle near the blade wingtip). The predetermined, helical twist is optimized for a particular angular position of the blade. As the solid blade is rotated to reduce the pitch under high differential pressure conditions, the pitch angle is reduced by the same amount along the length of the blade. Therefore, the pitch at the wingtip is overcompensated relative to the blade's pitch near the fan hub. Another disadvantage is the cost and maintenance of the mechanism to rotate each of the fan's blades, as well as the systems to control the rotation. Also, failure of these mechanisms and systems can cause great loss in critical, high-value applications.

Another design is to allow for flexibility in the wing of the fan blade itself. Some fans combine a rigid leading edge element with a curved, flexible wing element. The curved (cambered), flexible wing element trails the rigid leading edge and is sandwiched between and upper and lower portion of the rigid leading edge. The rigid leading edge is set at a fixed pitch. As the fan speed increases, thereby increasing the differential pressure (given the fixed system resistance coefficient), the flexible wing element is deflected away from the higher pressure side (the "lower" side as viewed as an airplane wing). The greatest degree of bending in the flexible wing element occurs where this flexible wing element connects to the rigid leading edge. Preloading (biasing) elements and/or limiters are provided to reduce localized stress and vibration, both of which could lead to failure.

One disadvantage of the above design is that the overall camber of the wing is more significantly reduced by the high differential pressure than the overall pitch of the wing. Thus, the lift that creates the differential pressure, generated by the angle of attach of the wing, is much greater than the lift generated by the camber of the wing under high differential pressure. Thus, this flexible fan blade can stall occur under high differential pressure, low flow conditions. Another disadvantage of this design is that the flexible wing element rubs against the preloading elements and/or limiters as it bends under high and low differential pressure or vibrates. Additionally, the preloading elements and/or limiters, located on the upper wing surface, affect the airflow over the airfoil and can contribute to the separation (stall) of airflow over the upper wing surface.

Yet another conventional design is a flexible fan blade that attaches directly to the fan hub, thus fixing both the camber and pitch of the wing near the fan hub. Between the fan hub and the wingtip, the leading edge is relatively rigid, while the curved, flexible trailing wing portion is deflected by the differential pressure. The fan wing is typically of one piece construction. While this design solves the problem of localized stress, rubbing and perturbed airflow as in the other designs described above, the wing pitch near the fan hub is fixed and can stall in this area. Also, the wingtip is subject to deflecting and vibrating about the blade's longitude, therefore limiting the safe speed and pressure differential of the fan.

Still yet another design includes a fan blade of flexible material attached to a rigid leading edge and includes materials of differing thermal expansion coefficients, whereby the blade curvature is increased by higher temperature and decreased by lower temperatures and aerodynamic lift on the blade. This type of fan is directed toward cooling of internal combustion engines. However, as with the other prior art designs, the overall camber of the wing is more significantly reduced by the high differential pressure than the overall pitch of the wing.

SUMMARY

This document describes a fan blade with a flexible airfoil wing. The fan blades maintain high efficiency over a wide range of pressure differentials and output flow.

In one aspect, an apparatus includes a flexible fan blade including a main spar and a curved, flexible wing, the lower surface of the main spar connecting to a lower portion of the curved, flexible wing. The lower portion of the curved, flexible wing extends to a leading edge of the curved, flexible wing. The leading edge of the curved, flexible wing extends to an upper surface of the curved, flexible wing, thereby creating a flexible airfoil of the flexible fan blade.

In another aspect, a fan includes a plurality of flexible fan blades connected at the root end of each of a plurality of multiple main spars that are connected to a common fan hub.

Each of the flexible fan blades includes a main spar and a curved, flexible wing, the lower surface of the main spar connecting to a lower portion of the curved, flexible wing, as described above.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a fan assembly including one or more fan blades having a flexible airfoil wing. In particular, a curved, flexible wing is connected to a main spar element located between the upper and lower portions of the curved, flexible wing element. The curved, flexible wing forms the entire upper surface of the wing, the entire leading edge of the wing, and a portion of the lower surface of the wing. As used herein, the terms "upper" and "lower" refer to the direction of the low pressure side and high pressure side of the fan, respectively.

Figure 1:
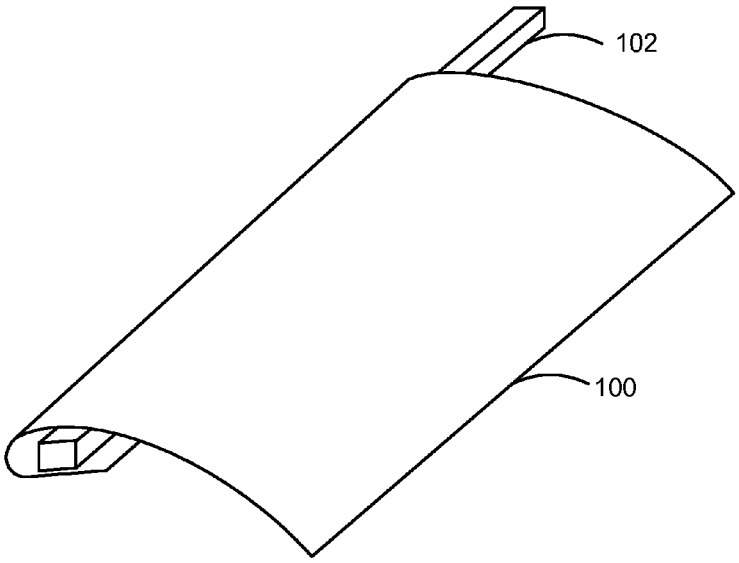
FIG. 1 is a perspective view of flexible fan blade connected to a main spar.
Figure 2:
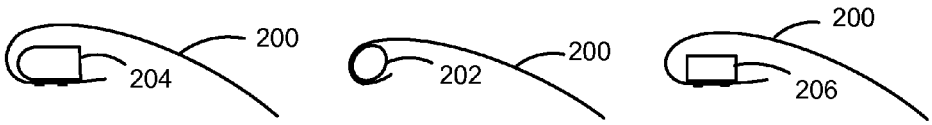
FIG. 2 illustrates various cross-sections of a fan blade and main spar.
Figure 3:
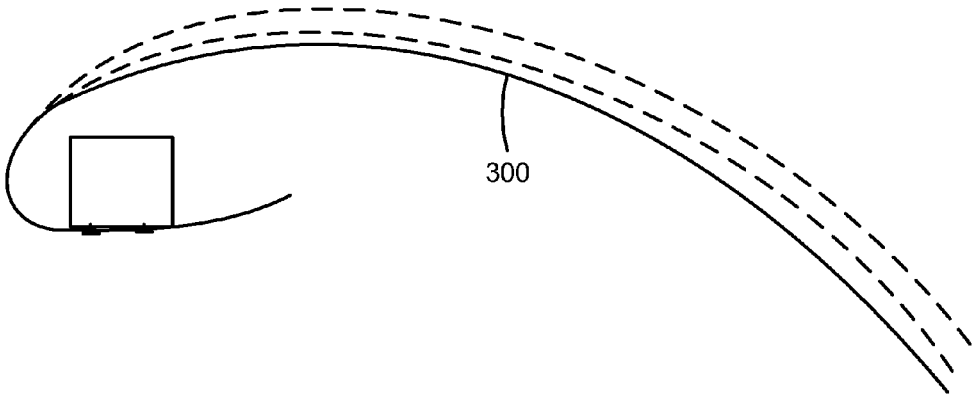
FIG. 3 illustrates deflection of a flexible fan blade in accordance with implementations described herein.
Figure 4:
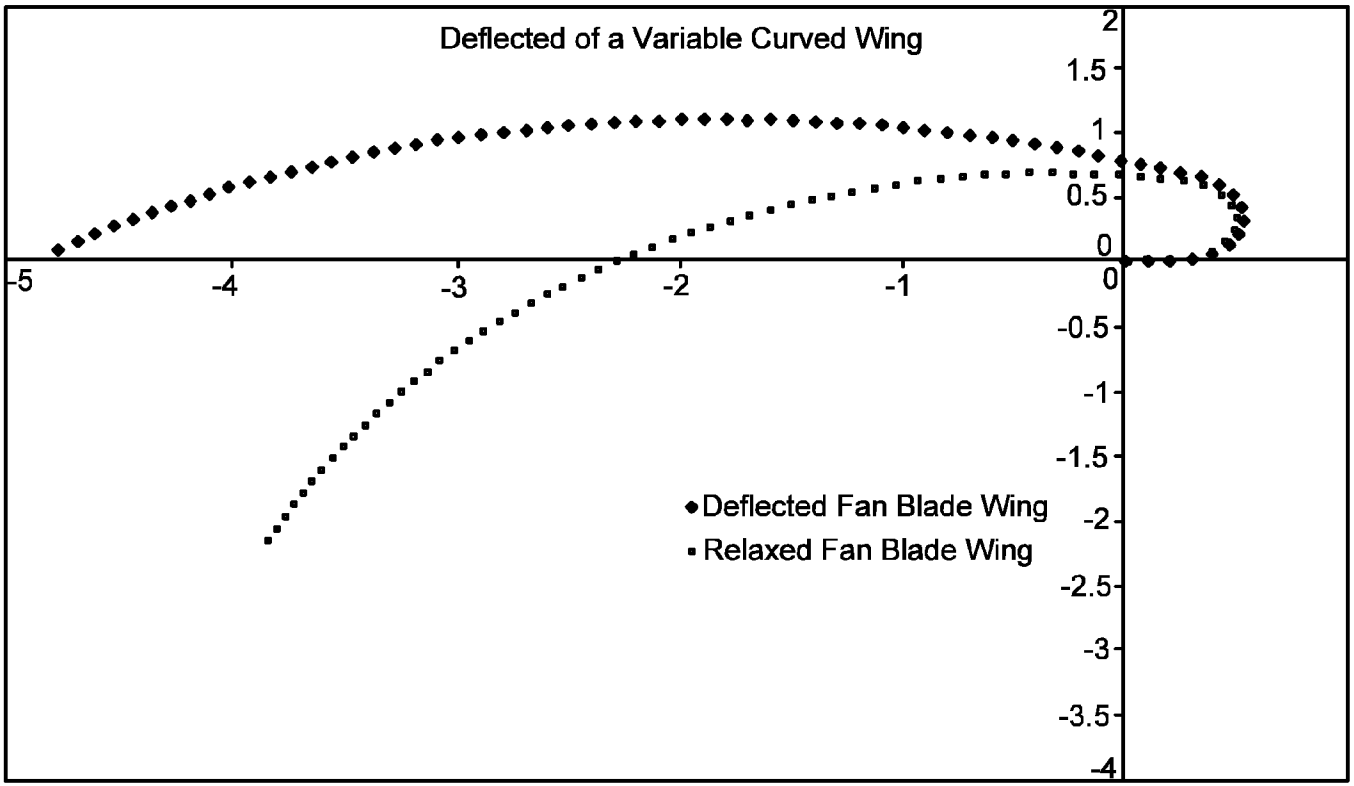
FIG. 4 further illustrates deflection of a flexible fan blade aluminum wing in accordance with implementations described herein.
Figure 5:
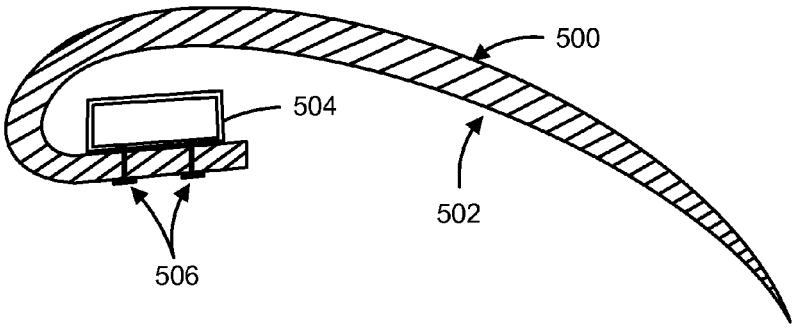
FIG. 5 is a cross section of a fan blade assembly having a layer of vibration damping material.
Figure 6:
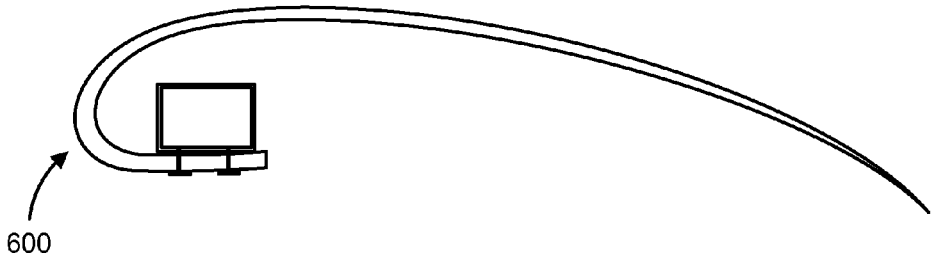
FIG. 6 is a cross section of a fan blade that has wing with varying thickness.
Figure 7:
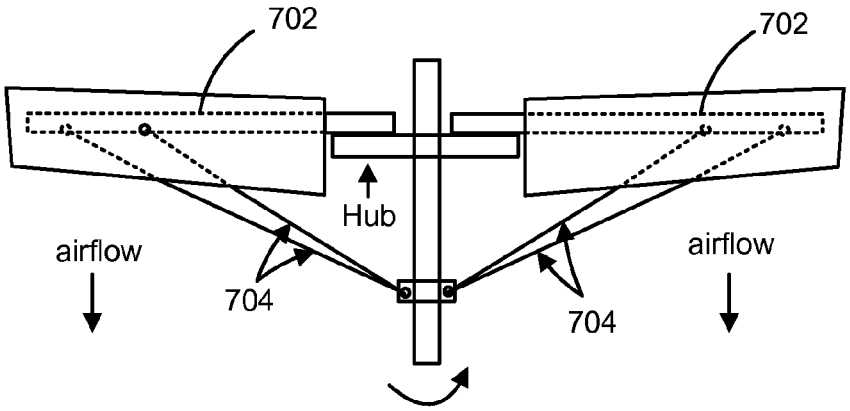
FIG. 7 illustrates a fan assembly with cable-stayed main spars.

The main spar is connected to the upper surface of the lower portion of the wing element at substantially the lower surface of the main spar (shown in FIGS. 1-6). The main spar runs substantially from the tip of the wing (the "wingtip") to the wing root (near the fan hub—not shown) and beyond, so that the main spar may be attached to the fan hub at a fixed or predetermined angle. FIG. 1 is a perspective view of a flexible fan blade 100 connected to a main spar 102. FIG. 2 illustrates various cross-sections of a fan blade 200 and one of any number of types and shapes of a main spar 202, 204, 206. FIG. 3 shows a flexible fan blade 300 having a limited degree of deflection in accordance with implementations described herein. FIG. 4 is a graph that illustrates a flexible fan blade aluminum wing in accordance with implementations described herein. FIG. 5 is a cross section of a fan blade assembly 500 having a fan blade wing 502 with a layer of vibration damping material, connected to a main spar 504 by bolts or other securing mechanisms 506. FIG. 6 is a cross section of a flexible fan blade 600 that has wing with varying thickness A main spar may be solid or hollow. The material composition, dimensions and wall thickness of the main spar are sufficient to resist aerodynamic forces of lift, drag and torsion. In some implementations, the main spar and flexible wing may be molded from a single mold so as to form one unit. The main spar may be cable-stayed or the like, by one or more cables connecting a point or points on the spar near the wingtip to the fan axis, such as the fan shaft, in order to increase the differential pressure capacity of the fan, and/or to otherwise decrease the axial load in the main spar itself. FIG. 7 illustrates a fan assembly with main spars 702 secured by cable stays 704.

The main spar may preload the wing's leading edge with internal torque to delay the deflection (bending) of the leading edge. This is accomplished with a main spar that is rounded near the leading edge of the wing with a radius of curvature greater than the relaxed radius of curvature of the leading edge of the wing. The main spar can be forced tight against the wing's leading edge, and then fastened to the upper surface of the lower portion of the wing element. The result of this implementation is to allow for a greater reduction in camber lift relative to angle of attack lift as the fan's differential pressure increases. Without the preloading, the camber lift remains relatively high compared to the angle of attack lift as the fan's differential pressure increases.

The flexible wing may be a composite of a thin, flexible material and an energy absorbing, vibration damping material. The energy absorbing, vibration damping material is preferably positioned inside the curve of the thin, flexible material, which would protect the energy damping material, especially at the leading edge of the wing.

The flexible wing may be of constant or varying thickness. If the wing thickness is greater in the area of the lower portion and the leading edge relative to the upper portion of the wing element, then the wing will exhibit a greater reduction in camber lift relative to angle of attack lift as the fan's differential pressure increases. If the thickness of the wing is less in the area of the lower portion and the leading edge relative to the upper portion of the wing, then the wing will exhibit a lesser reduction in camber lift relative to angle of attack lift as the fan's differential pressure increases.

Additionally, wing element thickness may vary from the wing root to the wingtip. If the wing thickness is less in the area of the wing root relative to the wingtip, then the wing root area will exhibit greater deflection as compared to a wing root of uniform thickness to the wingtip as the fan's differential pressure increases.

The flexible wing may be of constant or varying cord length. The aerodynamic lift of a section of wing is proportional to the cord length of that section for a given angle of attach and shape (i.e., camber as a percentage of cord length). The preferred implementation of a fan blade incorporates a wing with a greater cord length near the wing root than the wingtip in order to produce the fan differential pressure with a relatively low airspeed near the wing root.

The elasticity of a section of wing increases with an increased cord length of that section for a given shade. An exemplary preferred implementation of a flexible fan blade incorporates a wing with a greater cord length near the wing root than the wingtip in order to produce the greater wing deflection necessary near the wing root, thereby maintaining an ideal helical twist over the operating range of fan differential pressures.

Figure 8:
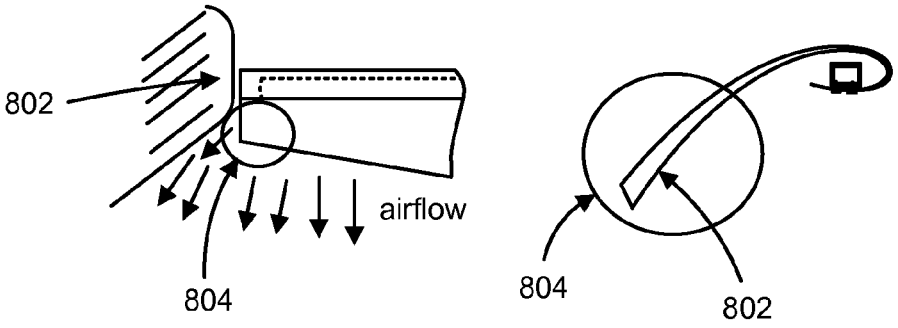
FIG. 8 illustrates a fan with a shroud and expansion cone.

A fan shroud with an expansion cone can be aligned axially with the fan blades so that the main spar is located at the bottom of the fan shroud, just above the expansion cone. FIG. 8 shows two views that illustrate a fan with a shroud 802 and expansion cone. The advantage of this alignment is to allow airflow near a trailing edge 804 of the wingtip, which is below the shroud when the differential pressure is relatively low, to flow radially off of the wingtip into the expansion cone. This reduces separation of airflow from the expansion cone and thus improves the conversion of the dynamic pressure into static pressure with the airflow. A radial camber may be added to the wingtip near the trailing edge to increase the downward velocity of the radial airflow from the wingtip into the region of the expansion cone.

Furthermore, as the differential pressure increases, the wingtip near the trailing edge is deflected upward into the region of the fan shroud, which allows for the production of maximum differential pressure. Under these conditions, the expansion cone serves little purpose as the air velocity through the expansion cone is minimal.

Figure 9:
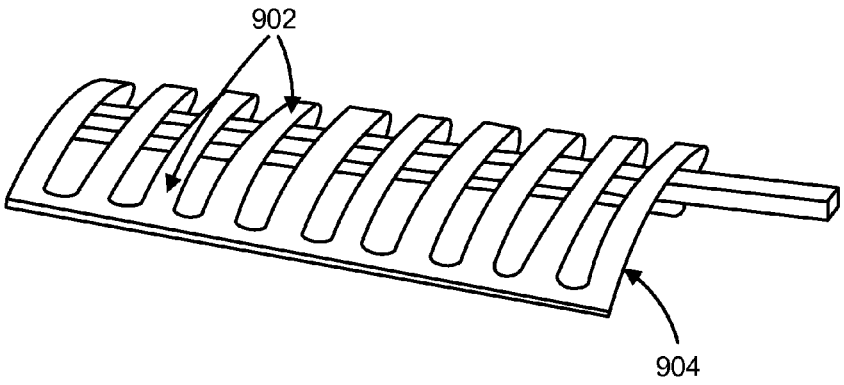
FIG. 9 illustrates a ribbed wing implementation where the ribs are connected.
Figure 10:
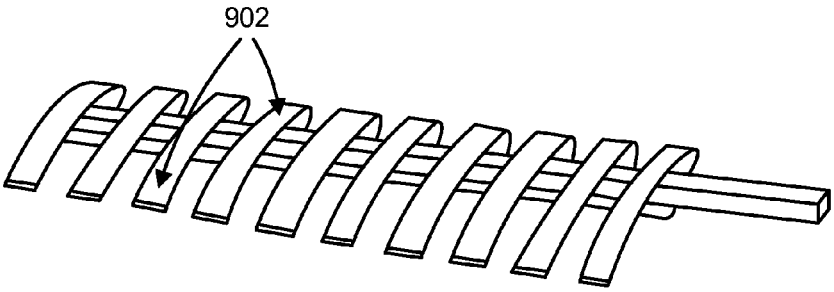
FIG. 10 illustrates a ribbed wing implementation where the ribs are floating.

The flexible wing may be a composite of flexible ribs and a flexible membrane. Each rib forms an airfoil cross-section of the wing, from the cross-section at the wing root to the cross-section at the wingtip. The upper surface of the lower portion of the ribs is connected to the main spar. Referring to FIGS. 9 and 10, the ribs 902 at the trailing edge of the upper portion of the wing may be attached to each other by wing root 904, as shown in FIG. 9, or floating, as shown in FIG. 10.

Figure 11:
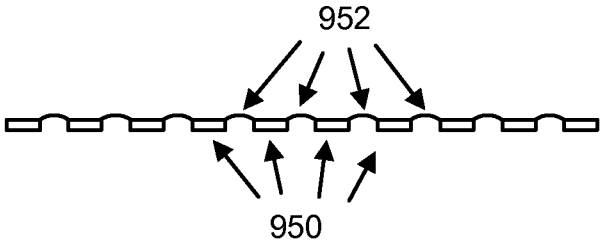
FIG. 11 shows a cross section of a ribbed wing implementation.

FIG. 11 shows a cross section of a ribbed wing 910 in accordance with some implementations. A flexible membrane 952 can be attached to ribs 950 and can span the gap between the ribs 950 in order to maintain separation in the airflows above and below the wing. The flexible membrane 952 is sufficiently loose between each rib 950 to allow for a predetermined deflection of each rib 950 without significantly deflecting the adjacent ribs 950, thereby allowing for a range of independent deflection of each rib 950 by aerodynamic forces.

Attached ribs at the trailing edge of the wing reduce the deflection of the ribs toward the middle of the fan blade by the resultant tension, induced by the aerodynamic forces, in the flexible membrane. In contrast, floating ribs at the trailing edge of the wing allow for more independent deflection of the ribs, thereby allowing for a greater independence in wing deflection from wing root to wingtip.

Although a few embodiments have been described in detail above, other modifications are possible. Other embodiments may be within the scope of the following claims.

The invention claimed is:

1. An apparatus comprising:

a flexible fan blade, the flexible fan blade comprising:

a curved, flexible wing having at least a lower portion, a leading edge, and an upper portion, the lower portion of the curved, flexible wing extending to the leading edge of the curved, flexible wing, the leading edge of the curved, flexible wing extending to the upper portion of the curved, flexible wing and the leading edge of the curved, flexible wing having a first radius of curvature in response to the curved, flexible wing being in a relaxed state and a second radius of curvature in response to the curved, flexible wing being in a deflected state, thereby creating a flexible airfoil of the flexible fan blade, the upper portion of the curved, flexible wing and the at least a lower portion of the curved, flexible wing forming an at least partially open channel adjacent the leading edge of the curved, flexible wing; and a main spar disposed in the at least partially open channel, the main spar having at least a lower surface, the lower surface of the main spar connecting to the lower portion of the curved, flexible wing.

2. The apparatus of claim 1, wherein the main spar and the curved, flexible wing are molded from a single mold.

3. The apparatus of claim 1, wherein the curved, flexible wing is a composite of a thin, flexible material and an energy damping material, thereby reducing the amplitude of wing vibration.

4. The apparatus of claim 3, wherein the energy damping material is disposed on an internal curvature of the upper portion of the curved, flexible wing.

5. The apparatus of claim 1, wherein the curved, flexible wing is of varying thickness.

6. The apparatus of claim 5, wherein the thickness of the lower portion of the curved, flexible wing is greater than the thickness of the upper portion of the curved, flexible wing.

7. The apparatus of claim 5, wherein the upper portion has a wing root portion and a wing tip portion and the thickness of the upper portion decreases from the wing tip portion to the wing root portion.

8. The apparatus of claim 1, wherein the upper portion is configured to flex causing the upper portion to move relative to the main spar.

9. The apparatus of claim 1, wherein the main spar comprises a leading edge having a third radius of curvature greater than the first radius of curvature and the leading edge of the main spar abutting an internal curvature of the leading edge of the curved, flexible wing.

10. The apparatus of claim 9, wherein the main spar preloads torsion in the lower portion and the leading edge of the curved, flexible wing.

11. The apparatus of claim 9, wherein the leading edge of the main spar having a second radius of curvature greater than the first radius of curvature of the leading edge of the curved, flexible wing and abutting the internal curvature of the leading edge of the curved, flexible wing reduces a camber lift relative to an angle of attack lift in response to an increase of a differential pressure of the flexible fan blade.

12. A fan comprising:

a plurality of flexible fan blades connected at a root end of each of a plurality of multiple main spars that are connected to a common fan hub, each of the flexible fan blades comprising at least:

a curved, flexible wing, having at least a lower portion, a leading edge, and an upper portion, the lower portion of the curved, flexible wing extending to the leading edge of the curved, flexible wing, the leading edge of the curved, flexible wing extending to the upper portion of the curved, flexible wing and the leading edge of the curved, flexible wing having a first radius of curvature in response to the curved, flexible wing being in a relaxed state and a second radius of curvature in response to the curved, flexible wing being in a deflected state, thereby creating a flexible airfoil of the flexible fan blade, the upper portion of the curved, flexible wing and the at least a lower portion of the curved, flexible wing forming an at least partially open channel adjacent the leading edge of the curved, flexible wing; and a main spar disposed in the at least partially open channel, the main spar having at least a lower surface and a leading edge having a second radius of curvature greater than the first radius of curvature, the lower surface of the main spar connecting to the lower portion of the curved, flexible wing and the leading edge of the main spar abutting an internal curvature of the leading edge of the curved, flexible wing.

13. The fan of claim 12, wherein the plurality of main spars are each cable-stayed by one or more cables connected to at least one point on each main spar near a tip of each of the flexible fan blades and the fan axis to at least a point below the multiple main spars, thereby reducing the axial load on each of the multiple main spars.

14. The fan of claim 12, further comprising a fan shroud and an expansion cone, wherein the multiple main spars are positioned axially at a lower edge of the fan shroud whereby a trailing edge of the curved, flexible wing, when undeflected, extends downward into the expansion cone, thereby allowing for radially outward airflow at the trailing edge of the curved, flexible wing, when undeflected.

15. The fan of claim 14, wherein a tip of each of the flexible fan blades, near the trailing edge of the curved, flexible wing, are curved downward to produce a radial camber, thereby producing additional downward velocity in the radially outward airflow from the tip, of each of the flexible fan blades, near the trailing edge into the expansion cone region.

16. The fan of claim 12, wherein the upper portion of each of the flexible fan blades is configured to flex causing the upper portion of each of the flexible fan blades to move relative to the main spar of each of the flexible fan blades.

17. The fan of claim 12, wherein the main spar comprises a leading edge having a third radius of curvature greater than the first radius of curvature and the leading edge of the main spar abutting an internal curvature of the leading edge of the curved, flexible wing.

18. The fan of claim 17, wherein the leading edge of the main spar having a second radius of curvature greater than the first radius of curvature of the leading edge of the curved, flexible wing and abutting the internal curvature of the leading edge of the curved, flexible wing, reduces a camber lift relative to an angle of attack lift in response to an increase of a differential pressure of the flexible fan blade.

19. An apparatus comprising:

a flexible fan blade, the flexible fan blade comprising:

a flexible wing, the flexible wing formed from a contiguous blade, the contiguous blade comprising:

a first end;

a second end opposite the first end;

a first portion adjacent the first end, the first portion configured to have a first radius of curvature in response to the contiguous blade being in a relaxed state and the first portion configured to have a second radius of curvature in response to the contiguous blade being in a deflected state; and a second portion adjacent the second end, the second portion having a second radius of curvature, the second radius of curvature less than the first radius of curvature and the second end being returned and directed toward the first portion forming an at least partially enclosed channel at the second portion; and a main spar disposed within the at least partially enclosed channel at the second portion of the contiguous blade, the main spar configured to abut the second portion when the contiguous blade is under a predetermined amount of tension.

* * * * *